United States Patent [19]

Brede et al.

[11] 3,973,500

[45] Aug. 10, 1976

[54] ELECTROMAGNETIC GENERATOR FOR PROJECTILES

[75] Inventors: Uwe Brede, Schwaig; Heinz Gawlick, Furth, both of Germany

[73] Assignee: Dynamit Nobel Aktiengesellschaft, Troisdorf, Germany

[22] Filed: Oct. 24, 1974

[21] Appl. No.: 517,625

[30] Foreign Application Priority Data

Nov. 3, 1973 Germany ..... 2355107

[52] U.S. Cl. ..... 102/70.2 G; 310/46

[51] Int. Cl.[2] ..... F42C 11/04

[58] Field of Search ..... 102/70.2 G, 70.2 R; 310/40, 41, 46, 152–156

[56] References Cited

UNITED STATES PATENTS

| | | | |
|---|---|---|---|
| 2,743,576 | 5/1956 | Crockett | 102/70.2 G |
| 3,401,635 | 9/1968 | Rabinow | 102/70.2 G |

*Primary Examiner*—Charles T. Jordan

*Attorney, Agent, or Firm*—Craig & Antonelli

[57] ABSTRACT

An electromagnetic generator for a projectile having a magnetic core, a coil system, a race duct and an element moveable in the race duct relative to the magnetic core for altering the magnetic field. An ignitable charge is provided for generating propellant gases which propellant gases cause at least initial movement of the element in the race duct.

16 Claims, 2 Drawing Figures

FIG. 1
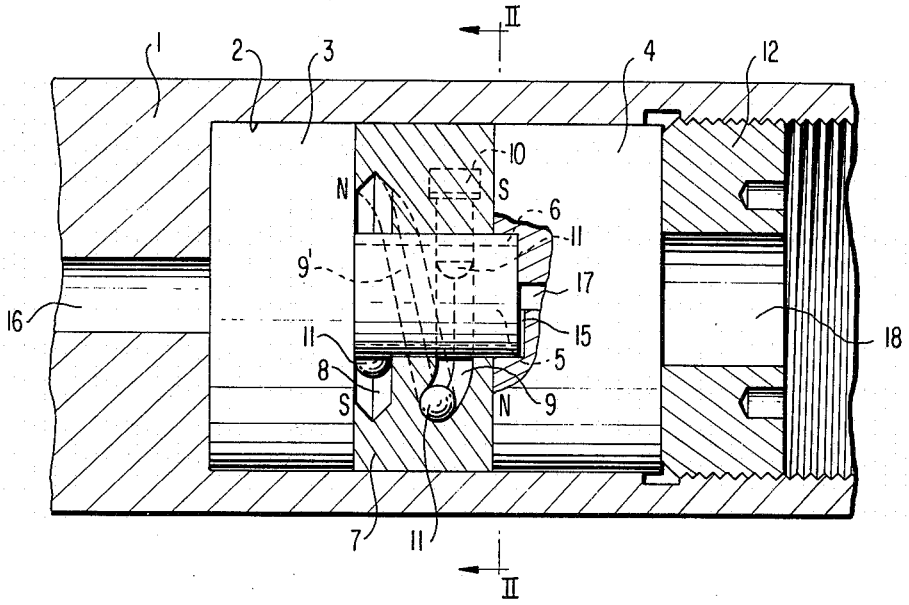
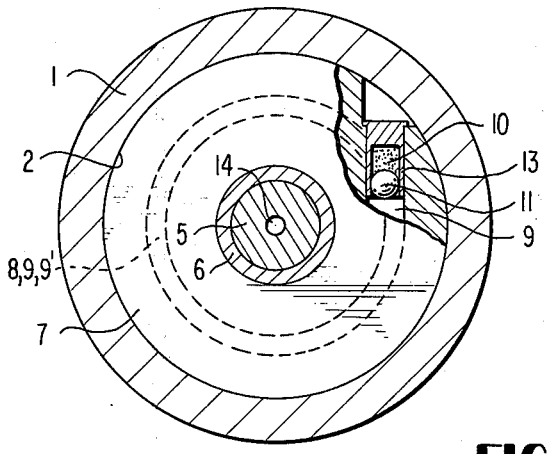
FIG. 2

ELECTROMAGNETIC GENERATOR FOR PROJECTILES

The present invention relates to an electromagnetic generator for a projectile having a fixedly arranged coil system and magnetic core, as well as a revolving element movable in a circular race duct relative to the magnetic core, thereby locally altering the magnetic field.

DOS (German Laid-Open Application) No. 2,160,294 discloses an electromagnetic generator for spin-stabilized projectiles wherein the coil system as well as the magnetic core are fixedly arranged relative to the projectile. The magnetic core is associated with at least one ball movable relative to this core along a circular track or path and thereby locally altering the magnetic field, whereby a corresponding electric voltage is induced in the coil system of the generator. The energy for the relative motion between the magnetic core and the ball is derived from the spin motion, i.e. the rotary movement of the projectile, since the ball, due to its mass movement of inertia, initially falls back as compared to the projectile and the magnetic core which are forcibly set into rotation during firing, and only gradually attains the rotary velocity of the projectile due to unavoidable frictional forces, so that there is no longer a relative motion between the magnetic core and the ball.

This electromagnetic generator has advantageously a very small structural size and also flawlessly withstands the high axial accelerations occurring during the firing of the projectile, which can be 500,000 g.'s (g. = gravitational acceleration) and thereabove. However, this generator cannot be utilized in projectiles without spin-stabilization and is furthermore limited in its efficiency even in case of spin-stabilized projectiles, by the magnitude of the spin of the projectile, inter alia.

The present invention is based on the problem of further developing an electromagnetic generator for a projectile, having a fixedly disposed coil system and magnetic core as well as a revolving element movable in a circular race duct relative to the magnetic core so as to locally alter the magnetic field, so that this generator can also be employed in projectiles which are not spin-stabilized and/or so that this generator, in spin-stabilized projectiles, makes it possible to produce a larger amount of electrical energy. In this connection, the generator is to be maximally simple and compact in its structure, safe in its function, even under adverse conditions, and capable of generating the electrical energy with minimum losses.

In order to solve this problem, the present invention provides an electromagnetic generator in which a revolving element is associated with a propellant powder charge ignitable at the instant the projectile is fired or launched, or at a predetermined, later point in time. The propellant gases of this charge serves for setting the revolving element in motion. The revolving element is preferably fashioned as a ball to keep friction at a minimum and to provide advantageous guidance possibilities. However, the revolving element can also be constructed, for example, as a cylindrical body more or less rolling along within the race duct, or as a body shaped like an annular segment, curved in correspondence with the shape of the race duct with this body sliding along within the race duct. The revolving element is conventionally produced preferably of a material of high permeability and low remanence, for example of "Mumetal" or relatively hard, sintered iron oxides. The latter are sold, for example, by the company SIEMENS A. G., Munich, Germany under the name of "Siferit" and/or by the company VALVO A. G., Hamburg, Germany under the name of "FXC."

Due to the feature of this invention of driving the revolving element by means of a special propellant powder charge, the generation of the electrical energy is advantageously no longer dependent on the rotation of the projectile, so that this generator is suitable, in particular, for projectiles which are not spin-stabilized. Of course, it is likewise possible, however, to use this generator in spin-stabilized projectiles insofar as an increase in the generated electrical energy is desirable therein. The arrangement, in this case, is provided so that the rotary motion of the revolving element due to the propellant powder charge takes place in the same direction of rotation as the motion due to its mass moment of inertia. By the choice of the propellant powder charge, i.e. its composition, quantity, reaction velocity, etc., it is possible, in addition to the individual design of, for example, the race duct and the revolving element, to effect an optimum adaptation to the requirements of each individual case. The propellant powder charge and the tamping thereof, which affects its reaction, are generally selected so that the revolving element has imparted thereto a maximally high initial impulse with a minimum of thus-generated gas quantity, so that the revolving element is minimally influenced in its once-initiated rotary motion by propellant gases subsequently flowing into the race duct. Examples for a propellant powder charge are powders on the basis of nitrocellulose or also powders of the type set forth in DAS (German Published Application) No. 1,646,313. The propellant powder charge is generally accommodated in a cartridge case closed at its front end. In case the revolving element is a ball, the latter is preferably inserted directly in the front end of the cartridge case so that this ball proper forms the tamping element. This results in a structural unit corresponding, in its external design, to the conventional Flobert cartridges with spherical bullet.

In accordance with a feature of the present invention, the propellant powder charge may be ignited directly upon firing or launching of the projectile or may be ignited at a predetermined, later point in time. The latter is generally preferred in view of the customarily required safety when the projectile is within the barrel of the weapon and after the projectile has left the barrel. Ignition can take place in a great variety of ways. To achieve a maximally simple construction of the projectile as well as the weapon, a feature of this invention provides that the propellant powder charge can be triggered with the aid of a primer responding to acceleration during firing, especially a piezoelectric primer element. The electrical energy produced by the piezoelectric primer element due to axial stress during firing is stored, for example, by an electric condenser and, after a predetermined time period has elasped, is conducted via appropriate leads to the electric primer element of the propellant powder charge, thus triggering the reaction of the latter. Instead of the piezoelectric primer element, it is also possible, however, to use a mechanical percussion primer element responsive to the firing shock, the ignition impulse of which is transmitted to the propellant powder charge for the revolving element via a pytrotechnical delay train of a predetermined burning time.

It is possible to initially arrange the revolving element in the race duct and hold it in a definite position with respect to the propellant powder charge, for example by means of elements which can be sheared off when a predetermined propellant gas pressure has been reached, by means of cemented or glued connections which can be separated or severed, or the like. According to another feature of this invention, the provision is made instead to have the revolving element enter the race duct from the side via an injection duct, under the effect of the propellant gases. For this purpose, the injection duct may be fashioned, for example, to terminate tangentially into the annular race duct. The separate injection duct furthermore offers the advantage of providing more freedom with respect to the definite positioning of the revolving element and of improving the adaptability to the spatial conditions present in an individual case. In accordance with a further feature of this invention, however, this also affords the possibility of joining the injection duct with the race duct so that the race surface of the latter for the revolving element is not interrupted by the injection duct. For this purpose, it is possible, for example, to have the injection duct — as seen in a longitudinal section — enter into the race duct from the side. The revolving element is laterally fired from the outside by means of a propellent powder charge via the injection duct into the rotationally symmetrical race duct and travels therein, on account of the centrifugal force, along a track surface no longer interrupted by the injection duct, so that the movement of the revolving element is not disturbed, advantageously, by any shoulders, perforations, or the like in the race surface, and the energy losses otherwise caused thereby are thus avoided. Furthermore, with a view toward a maximally uniform guidance of the revolving element, the invention provides to fashion the injection duct, at least in its central zone, with the same curvature as the race duct, in a helical configuration.

The race duct as well as the optionally provided injection duct may be formed within the magnetic core proper. However, to simplify the manufacturing process even further, the invention includes the additional feature of fashioning the race duct and the optionally provided injection duct in a separate insert member of a magnetically nonconductive material, in which the propellant powder charge with the revolving element is inserted in a bore tangentially passing over into the race duct and/or the injection duct. This separate insert member has the additional advantage that the different requirements to be met by the magnetic core and the race duct can be better satisfied, in selecting the materials which are most suitable for the respective purpose. Thus, according to the present invention, the insert member is produced of a ceramic, material, especially of ceramic aluminum oxide. This material is very hard and wear-resistant as compared to soft iron which may also be employed, for example, whereby a maximally favorable movement of the revolving element in the insert member is attained, consuming only a small amount of energy.

The mechanical stress existing between the revolving element and the race duct as well as optionally the injection duct is, in this case, of great significance due to the extraordinarily high numbers of revolution per unit time, executed by the revolving element. As has been found, injection velocities of between about 40 and 100 m./sec. are selected for the revolving element in case of the customary projectile calibers. However, in case of a race duct diameter of, for example, 15 mm., the number of revolutions per minute for the revolving element range between about 50,900 and 127,000. Lower injection speeds have proved to be unsuitable in general, due to the required minimum electrical energy for the primer functions to be executed within the projectile, such as, for example, the overshoot delay or self-destruction in case the target is missed. However, injection speeds lying above 100 m./sec. result, depending on the material of the magnetic cores used in an individual case, in such a great increase in energy losses in these cores because of the chronologically extremely rapid changes in the magnetic flux that the increase in injection speed is hardly useful any more under practical conditions.

These and other objects, features and advantages of the present invention will become more apparent from the following description when taken in connection with the accompanying drawing, which shows, for purposes of illustration only, one embodiment in accordance with the present invention, and wherein:

FIG. 1 is a fragmentary view in partial longitudinal section of a projectile with an electromagnetic generator in accordance with the present invention; and FIG. 2 is a cross sectional view taken along line II—II of FIG. 1.

Referring now to the drawing wherein like reference numerals designate like parts throughout the several views, there is shown in FIG. 1, a projectile 1 provided with a recess 2 in which an electromagnetic generator is disposed. The generator comprises an annular magnet 3 and a pot-shaped magnet 4. Both magnets, shown in a plan view, contain in a succession in the peripheral direction thereof alternating magnetically polarized sectors, for example, eight or twelve sectors. Two respective sectors are indicated in FIG. 1 by the designations N and S for north pole and south pole. The magnetic cores 3, 4 are preferably produced of "Alnico" alloys to provide increased shock resistance, but they could also be made, for example, of sintered iron oxides. The annular magnet 3 is placed on a central pin 5 made of a magnetically conductive material, e.g. soft iron or "Mumetal." Furthermore, the pin 5 carries a coil system 6, accommodated in a double-walled brass sleeve. The brass sleeve, made with relatively thin walls, serves only for the protection of the coil system 6 from damage, for example during the mounting of the generator. To increase the impace resistance, the coil system 6 is suitably cast into the brass sleeve with a synthetic resin, for example on an epoxy resin basis. The magnetic lines of flux, which are not shown in order to provide clarity of the illustration, pass from the magnetic poles through the pin 5 and thus also penetrate the coil system 6. Of course, it is possible to choose a different mutual arrangement and design of magnetic cores, pin, and coil system, insofar as this should prove advantageous in a particular case.

A separate insert member 7, made of a ceramic aluminum oxide and placed on the pin 5 with the coil system 6, is disposed between the magnetic cores 3, 4. A race duct 8 and a helically wound injection duct 9 having a propellant powder charge 10 inserted therein are provided in the insert member 7. The injection duct 9 extends in its initial zone below the pin 5 and thus is indicated herein in dashed lines, as is the propellant powder charge 10. In order to be able to illustrate the entrance of the injection duct 9 into the race duct 8, the dashed lines also indicate herein the half winding 9' of the injection duct 9 actually cut away and lying above the plane of the drawing. One and the same revolving element 11, in this case illustrated as a ball, is shown in different, chronologically successive positions in the ducts 8 and 9. The entire generator is mounted in a predetermined position within the recess 2 of the projectile 1 by means of a screw-in element 12.

FIG. 2 shows more clearly the arrangement of the propellant powder charge 10 with the revolving element 11, inserted in a bore 13. The bore 13 passes over tangentially into the injection duct 9. For the sake of clarity, the magnetic core 4 is omitted in this illustration. The pin 5, on which the coil system 6 is placed, has a longitudinal bore 14. Electrical leads of the coil system 6, which are not shown, are extended via a radial groove 15 in the magnetic core 4 (FIG. 1), the longitudinal bore 14, and a bore 16 to an electric control unit, not shown, disposed in front of the generator, which serves for effecting the respective projectile igniter or primer functions. From this control unit emanate again corresponding electric connection lines, not shown, passing through the bores 16, 14, 17, and 18 to a primer train arranged behind the generator and not shown in the drawing, which effects in a conventional manner, for example, the initiation of a bursting charge. This three-dimensional or spatial arrangement of the control unit, the generator, and the primer train is effected advantageously when these components are accommodated within the nose of the projectile, whereas, for example, in case of a mounting in the bottom of the projectile, the primer chain, as well as the bursting charge are disposed in front of the generator. For the electric ignition of the powder charge 10, electric connection lines are provided, likewise not shown, which are extended via corresponding axial and radial grooves, not shown, in the insert member 7 and the magnetic core 4 to the bore 17 and from there to a conventional piezoelectric primer element, not shown, which is arranged in the projectile at a suitable location.

While we have shown and described only one embodiment in accordance with the present invention, it is understood that the same in not limited thereto but is susceptible of numerous changes and modifications as known to those skilled in the art, and we therefore do not wish to be limited to the details shown and described herein but intend to cover all such changes and modifications as are encompassed by the scope of the appended claims.

What is claimed is:

1. An electromagnetic generator for a projectile comprising a magnetic core, a coil system, a race duct, element means movable in said race duct relative to said magnetic core for locally altering the magnetic field, and ignitable charge means for generating propellant gases which propellant gases cause at least initial movement of said element means in said race duct.

2. An electromagnetic generator according to claim 1, further comprising an injection duct coupled to the side of the race duct for permitting entry of the element means under the effect of the propellant gases into said race duct from the side thereof via said injection duct.

3. An electromagnetic generator according to claim 2, wherein said injection duct is coupled to said race duct such that an uninterrupted running surface for said element means is provided in said race duct.

4. An electromagnetic generator according to claim 2, wherein said race duct is circular and said injection duct is provided in at least a central zone thereof with the same curvature as said race duct in a helical configuration.

5. An electromagnetic generator according to claim 4, wherein said injection duct is coupled to said race duct such that an uninterrupted running surface for said element means is provided in said race duct.

6. An electromagnetic generator according to claim 1, wherein said race duct is disposed in a separate member of a magnetically nonconductive material.

7. An electromagnetic generator according to claim 6, wherein said race duct is a circular race duct, and a bore is provided in said separate member which bore passes tangentially into said race duct, said ignitable charge means and said element means being at least initially positioned in said bore.

8. An electromagnetic generator according to claim 7, wherein said separate member is formed of a ceramic material.

9. An electromagnetic generator according to claim 8, wherein said ceramic material is a ceramic aluminum oxide.

10. An electromagnetic generator according to claim 6, wherein said race duct is a circular race duct and said separate member being provided with an injection duct coupled to said race duct, said separate member having a bore which tangentially passes into said injection duct, said ignitable charge means and said element means being at least initially positioned in said bore, said element means being movable from said bore through said injection duct into said race duct.

11. An electromagnetic generator according to claim 10, wherein said insert member is formed of a ceramic material.

12. An electromagnetic generator according to claim 11, wherein said ceramic material is a ceramic aluminum oxide.

13. An electromagnetic generator according to claim 1, wherein said race duct is a circular race duct and said magnetic core and coil system are fixedly positioned with respect to one another within the projectile.

14. An electromagnetic generator according to claim 13, wherein a member of a magnetically nonconductive material is fixedly positioned with respect to said magnetic core and said coil system, said member having said race duct and an injection duct coupled to said race duct disposed therein such that said element means moves into said race duct via said injection duct.

15. An electromagnetic generator according to claim 14, wherein said member is provided with a bore which tangentially passes into said injection duct, said ignitable charge means and said element means being at least initially positioned in said bore, said element means being movable from said bore through said injection duct into said race duct.

16. An electromagnetic generator according to claim 15, wherein said injection duct is provided in at least a central zone thereof with the same curvature as said race duct in a helical configurationn, said injection duct being coupled to said race duct such that an uninterrupted running surface for said element means is provided in said race duct.

* * * * *